United States Patent [19]

Graf

[11] 4,158,118

[45] Jun. 12, 1979

[54] ELECTROSTATIC SWITCH

[76] Inventor: Ronald E. Graf, Rte. 3, Box 520, Crozet, Va. 22932

[21] Appl. No.: 648,572

[22] Filed: Jan. 12, 1976

Related U.S. Application Data

[62] Division of Ser. No. 502,224, Aug. 30, 1974, Pat. No. 3,955,059.

[51] Int. Cl.[2] ..... H01H 51/00

[52] U.S. Cl. ..... 200/181; 137/251; 200/187

[58] Field of Search ..... 200/181, 214, 219, 220, 200/221, 187, 188, 18.9, 33 A, 61.47 A; 137/251-254

[56] References Cited

U.S. PATENT DOCUMENTS

| | | | |
|---|---|---|---|
| 2,802,918 | 8/1957 | Boyle | 200/181 |
| 3,222,469 | 12/1965 | Morris | 200/33 A |
| 3,548,857 | 12/1970 | Anderson | 137/251 |
| 3,612,794 | 10/1971 | Winter | 200/81.6 |
| 3,973,092 | 8/1976 | Breed et al. | 200/221 |

*Primary Examiner*—Harold J. Tudor

[57] ABSTRACT

An electrostatically controlled electrical relay switch is disclosed which includes two chambers joined together by a constricted region therebetween. A conducting liquid, such as mercury, is positioned in one of the chambers and the movement thereof between the chambers is controlled by an electrostatic field. Electrical conductors extend into at least one of the two chambers so that when the conductive liquid is moved into a chamber, the electrical conductors therein are electrically coupled to one another. In an alternative embodiment, the movement of the conductive liquid between the two chambers acts as a means for switching fluid or a light beam. A dielectric fluid could be substituted for conductive fluid in the optical or fluidic switch. Also more than two chambers are possible. In the case of multiple chambers they may be grouped in a string each closest pair being separated by a constricted region or the chambers may be grouped around a single constricted region. A combination of the two groupings may communicate in one switch.

12 Claims, 17 Drawing Figures

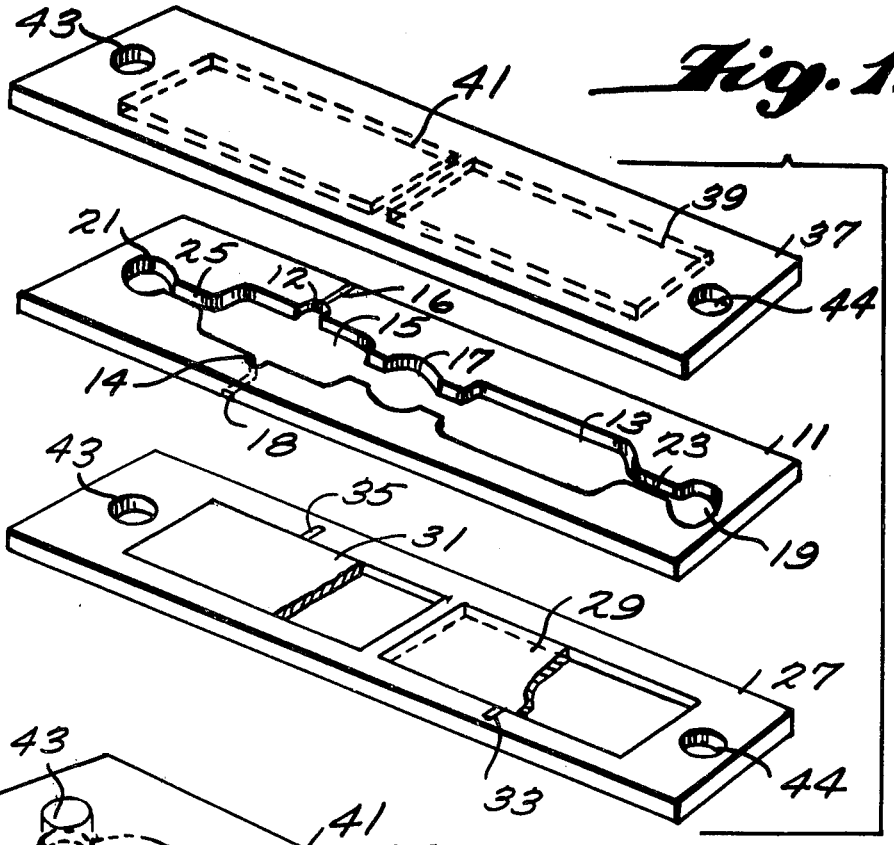
Fig. 1.
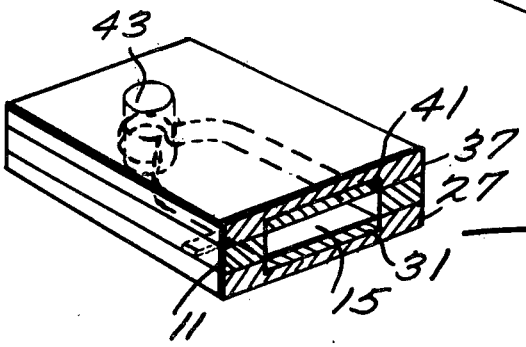
Fig. 1a.
Fig. 2.
Fig. 10.
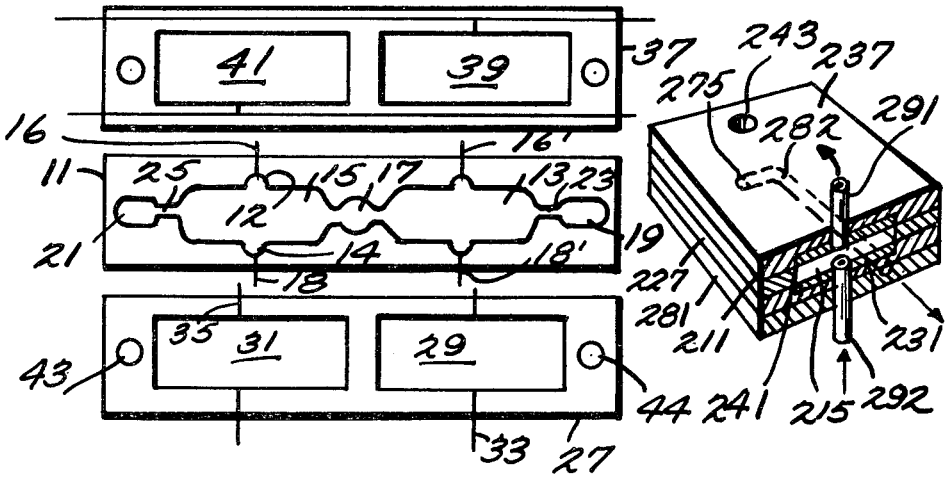

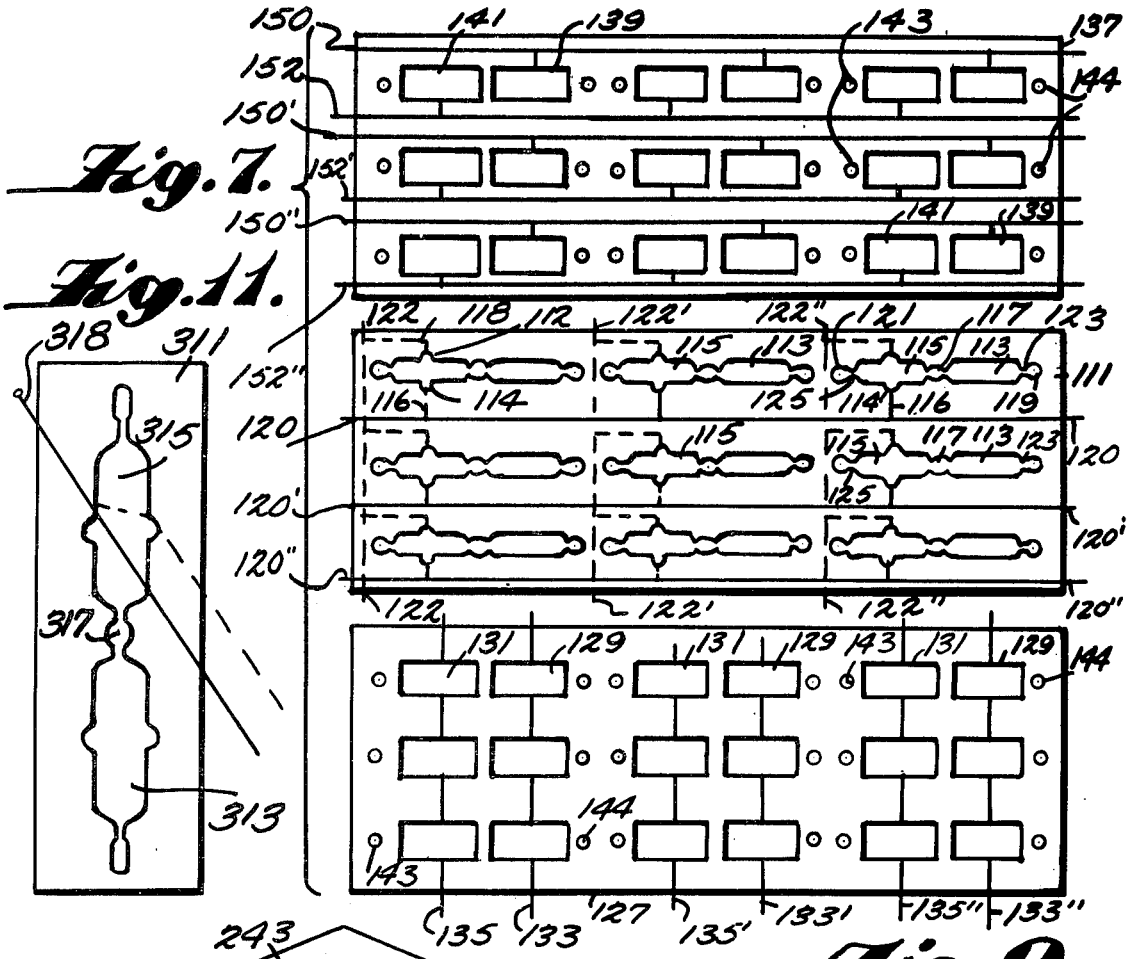
Fig. 7.
Fig. 11.
Fig. 9.
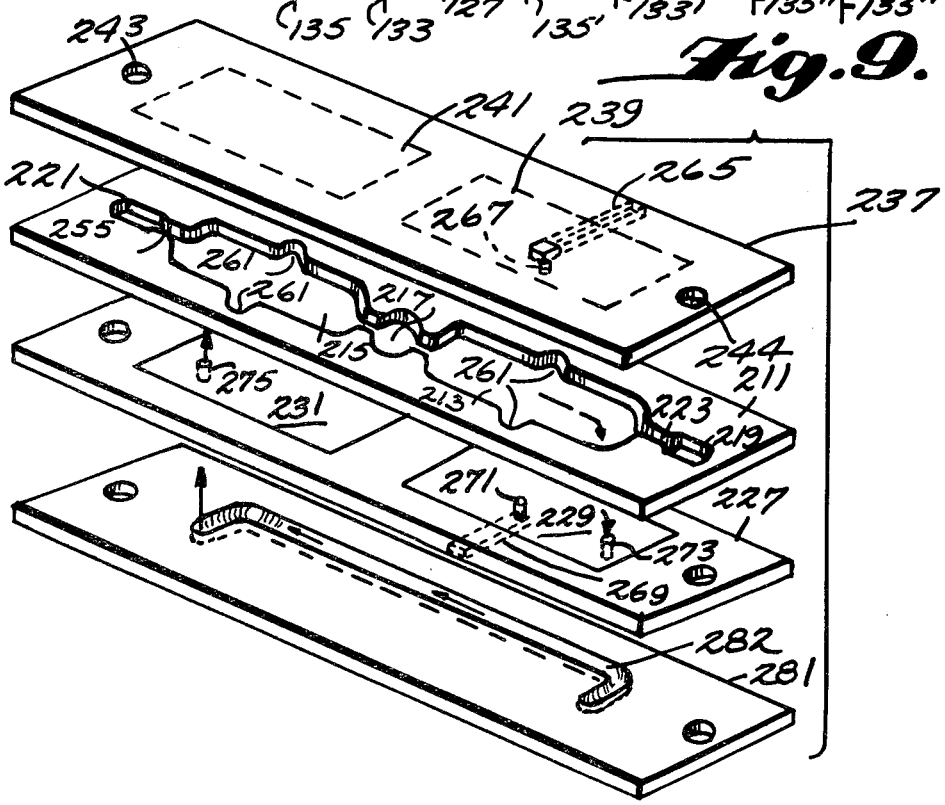

ELECTROSTATIC SWITCH

This is a division, of application Ser. No. 502,224 filed Aug. 30, 1974, now U.S. Pat. No. 3,955,059.

BACKGROUND OF THE INVENTION

This invention relates to electrostatically operated switches for controlling electrical, fluidic or optical circuits.

The trend in the design of present day electronic circuits for use in systems such as telephone, computer and information handling systems is toward ever increasing application of integrated circuit technology which permits the employment of batch fabrication techniques in the manufacture of the switches. Thus, significant improvements have been achieved in reducing the size and cost of the logic control and processing circuitry for these systems. However, the switching devices which have been provided to date have been quite complex and have had less than adequate reliability. Accordingly, there is a need for a simple yet reliable electronic switching means which can be fabricated by integrated circuit techniques.

It therefore is an object of this invention to provide a simple but reliable electrostatically operated switch for controlling electrical, fluidic or optical circuits.

SHORT STATEMENT OF THE INVENTION

Accordingly, this invention relates to an electrostatically controlled relay switch capable of fabrication by integrated circuit techniques. Broadly described, one embodiment of the present invention includes at least two pairs of opposed conductive plates separated by two chambers which are joined together by a constricted region therebetween. A conductive fluid, such as mercury, is positioned in one of the chambers so that a portion of the fluid extends partially between the plates of an adjoining chamber through or in the constricted region. When an electrostatic field is impressed across one of the chambers by applying a voltage to the conductive plates defining the top and bottom of the chamber, the conductive liquid is drawn thereinto. A pair of conductors extend into at least one of the chambers so that when the conductive liquid is drawn into the chamber, the electrical conductors are electrically connected. In alternative embodiments, light energy or fluid is conducted to one or more of the chambers and the passage of the light energy or fluid through the chamber is controlled by the presence or absence of the conductive liquid in the chamber. A dielectric liquid may replace the conductive liquid in alternative embodiments. Also a string or a group of chambers or a combination of strings and groups of chambers separated by constricted regions is contemplated.

BRIEF DESCRIPTION OF THE DRAWINGS

Other objects, features and advantages of the present invention will be more fully understood from the following detailed description, appended claims and the accompanying drawings in which:

FIG. 1 is an exploded perspective view of the electrostatic switch of the present invention, FIG. 1*a* is a partial perspective view of the electrostatic switch of the present invention, FIG. 2 is a planar view of components of the switch showing the electrical connections thereto, FIG. 7 is a schematic representation of an array of electrostatic switches, FIG. 9 is an exploded view of an alternate embodiment of the electrostatic switch of the present invention capable of switching optical or fluidic signals, FIG. 10 is a partial perspective view of an electrostatic switch similar to that of FIG. 9 showing different means of signal entrance and egress, FIG. 11 is a plan view of an alternative embodiment of the electrostatic switch of the present invention capable of switching optical signals;

DETAILED DESCRIPTION OF THE PREFERRED EMBODIMENT

Figure 3:
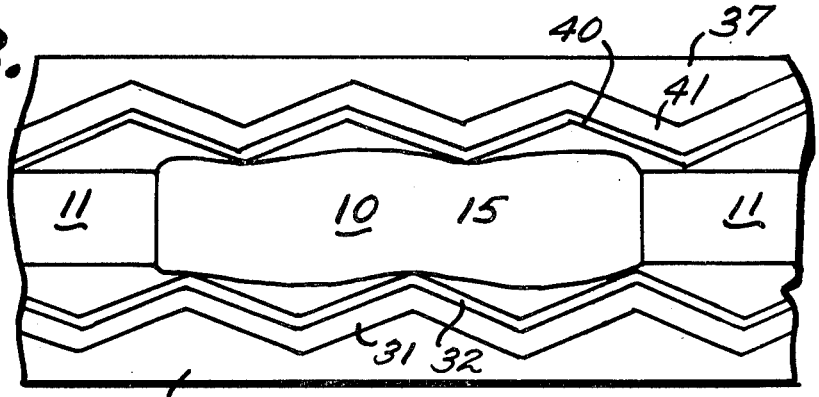
FIG. 3 is a cross-sectional view of the electrostatic switch wherein the conductive plates defining the top and bottom of the chambers are serrated.

Refer now to FIGS. 1 and 1*a* where there is disclosed a first embodiment of the present invention. A first dielectric plate 11 which is of a relatively thin elongated structure has a first and second chamber 13 and 15, respectively, formed therein, which chambers are connected by means of a constricted region 17. At the other end of each of the chambers is a through-hole 19 and 21, respectively, which through-holes are connected to the associated chambers 13 and 15, respectively, by means of channels 23 and 25, respectively.

Cavities 12 and 14 are formed on opposite sides of at least one of the chambers, as illustrated, in order to entrap conductive liquid therein. A conductor 16 is plated by known techniques onto the plate 11 such that the conductive material, e.g., copper, extends from the outside edge of the plate 11 to the cavity 12 and then extends downwardly along the wall of the cavity in a vertical direction to ensure a good electrical contact with the conductive liquid which is entrapped in the cavity. On the opposite side of the chamber a conductive layer 18 is plated by known techniques on the underside of the plate 11 such that the conductor extends from a position remote from the chamber 15 to the cavity 14 and then upwardly along the wall of the cavity, as illustrated in dotted lines. While the conductor is shown as plated onto the plate 11 in the preferred embodiment, it should be understood that the conductor could be in the form of a wire which projects into the cavities 12 and 14.

Positioned below plate 11 is a substrate plate 27 which plate is formed of a dielectric material. Electrode plates 29 and 31 are formed on the surface of the dielectric substrate 27 by one of several known means, such as, for example, sputtering, spraying, painting, etc. These electrodes are connected to electric lines 33 and 35 which may be formed on the substrate 27 by means of sputtering, spraying, etc. A very thin dielectric coating (not shown) is placed or deposited over the conductive plates and a thicker coating (not shown) is placed over the conductive lines. The dielectric coating on the plates may be an oxide layer formed by anodizing the metal of the conductive plates. In one alternative the coating on the lines may be simply another laminar layer. The substrate 27 is secured to the bottom side of dielectric plate 11 by any suitable technique known in the art.

An upper dielectric substrate 37 is provided having a structure similar to that of substrate 27 and has a pair of electrode plates 39 and 41 deposited on the underside thereof in a manner similar to the conductive plates 29 and 31. In addition, connecting lines (not shown) are deposited on the substrate which extend from the conductive plates to the edge of the dielectric substrate. These lines can be formed on the surface of the dielectric by any one of several means known in the art. In the alternative, it should be understood that the lines which extend from the conductive plates could be extended through the dielectric substrates 27 and 37 in a direction perpendicular to the plane thereof. The dielectric substrate 37 is placed over the top of dielectric plate 11 and secured thereto to form a composite switch such as illustrated in partial section in FIG. 1*a*. As illustrated in FIG. 1*a*, the chamber 15 formed in the dielectric plate 11 is bordered on the top and bottom thereof by the conductive plates 41 and 31, respectively. A conductive liquid, such as mercury, is introduced into the chamber 15 via a hole 43 which is aligned with the through-hole 21 in the dielectric plate 11. If, for example, a plurality of the switches of the present invention are stacked one on top of another, the throughholes 21 and the holes 43 to the dielectric substrates are aligned with one another so that mercury or other conductive fluid can be introduced to a plurality of chambers 15 simultaneously. After the conductive fluid is introduced into the chamber in the plate 11, the hole 43 is sealed either permanently or temporarily. At the same time the through hole 44 at the opposite end of the switch is also sealed. The purpose for having the hole 44 is to permit gas to escape from the chambers as the mercury is introduced therein. If the holes 43 and 44 are temporarily sealed, such as by a meltable solder, wax or other material or by the insertion of a rod therethrough, the chambers 13 and 15 can from time to time be flushed out, cleaned, reanodized and then refilled with the conductive liquid. Thus a serviceable electrostatic switch is provided which can be easily maintained with age. The sealing will prevent evaporation as well as escape of the conductive liquid. The surfaces of plates 37, 27, and 11 of FIGS. 1 and 1*a* may be flat or undulating. The undulations can correspond to the shape and constrictions in plate 11, thus enhancing the effect of the constrictions. The undulations could actually replace the constrictions and canals.

Refer now to FIG. 2 where there is illustrated a schematic planar view of each of the layers which comprise the switch. The dielectric plate 11 is shown having chambers 13 and 15 formed therein which chambers are separated by a constriction 17. At the opposite ends of each of the chambers 13 and 15 are formed throughholes 19 and 21, respectively, which holes are separated from the chambers by means of channels 23 and 25. Cavities 12 and 14 are formed in the chamber 15 for providing a recessed area into which the conductors 16 and 18 enter the chamber. These cavities have a tendency to retain the liquid conductor therein even when the liquid conductor moves from chamber 15 to chamber 13. Thus, the exposed portion of the conductors 16 and 18 remains wetted so as to provide a good electrical contact between the liquid conductor and the metal conductors 16 and 18. If conductive leads are extended to chamber 13, cavities of similar design are provided at the sides thereof, as illustrated, for the purpose of insuring a good electrical contact between the conductors which extend into the chamber and the liquid conductor which electrically connects the conductors to one another.

Positioned under layer 11 is a dielectric substrate 27 which has holes 43 and 44 therethrough at the respective ends thereof. In addition, conductive plates 29 and 31 are positioned on the dielectric substrate 27, as aforementioned, with a very thin insulating layer positioned over the top thereof. A conductive lead extends to the conductive plate 29 and a second conductive lead 35 extends to the conductive plate 31. Positioned on top of the layer 11 is a second dielectric substrate 37 having a pair of conductive plates 39 and 41 plated thereon, which plates appear opposite the plates 29 and 31, respectively, when dielectric substrate 37 is folded over on top of layer 11. As aforementioned, each of the conductive plates 39 and 41 has a very thin dielectric layer formed over the top thereof in order to insulate plates 39 and 41 from the conductive liquid within the chambers 13 and 15. The substrates 27 and 37 sandwich the layer 11 as illustrated in FIG. 1*a* to form a composite electrostatically operated switch.

In operation after a conductive liquid, such as mercury, has been injected into one of the chambers 13 or 15 via aligned holes 43 and 21 or 44 and 19, the holes are sealed. Assuming that a dielectric liquid is initially positioned in chamber 15, a voltage is established across plates 29 and 39, thereby attracting the conductive liquid from chamber 15 to chamber 13. When the conductive liquid has entered the chamber 13, the current passing from conductor 16 through the liquid in chamber 15 to the conductor 18 will be cut off. If a two-way switch is desired, conductive leads can extend into chamber 13 in which case lead 16' is electrically connected to lead 18' via the conductive liquid.

Figure 4:
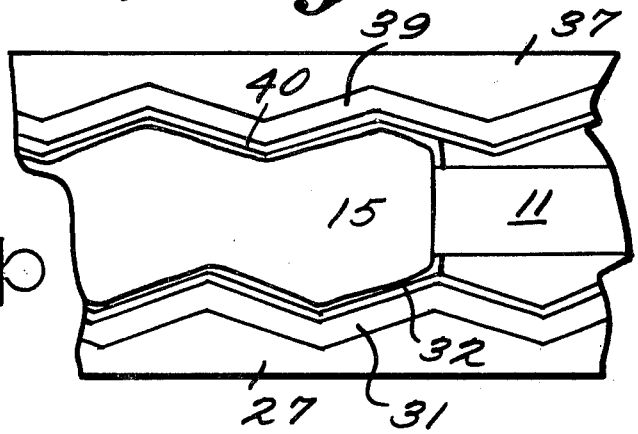
FIG. 4 is a cross-sectional view of the electrostatic switch of the present invention showing the conductive liquid therein after a voltage has been applied to the conductive plates which define the top and bottom of the chamber.

Refer now to FIGS. 3 and 4 which are cross-sectional views of the electrostatic switch of the present invention showing the conductive plates as being of a serrated configuration. The central dielectric layer 11 is illustrated defining a chamber 15 which contains the liquid conductive material. The lower substrate 27 is serrated in the form of a saw-tooth waveform with a layer of a conductive material 31 deposited thereon by techniques known in the art. The peaks should be rounded to avoid large electric fields. Over the top of the conductive layer 31 is positioned a relatively thin dielectric material 32 such as might be provided by anodizing the conductive plate 31. Above the layer 11 and the conductive liquid 10 is positioned the upper dielectric substrate 37, also having a conductive layer 41 deposited thereon with a dielectric layer 40 which is very thinly formed on top of the plate 41 to thereby insulate the plate 41 from the conductive liquid 10. As illustrated in FIG. 3, no voltage is applied across the plates 41 and 31 and accordingly, the surface tension of the conductive liquid 10 forms the conductive liquid into a generally rectangular shape.

With specific reference to FIG. 4, a voltage is applied across the conductive liquid 10 and it can be seen that the conductive liquid is drawn into the serrations of the switch formed by the conductive plates 31 and 41 and their dielectric layers 27 and 37, respectively. In this configuration, the conductive liquid is drawn away from the constriction 17, illustrated in FIGS. 1 and 2, in order to make a solid electrical contact between the conductive elements 16 and 18 extending into the opposite sides of the chamber 15.

Figure 5:
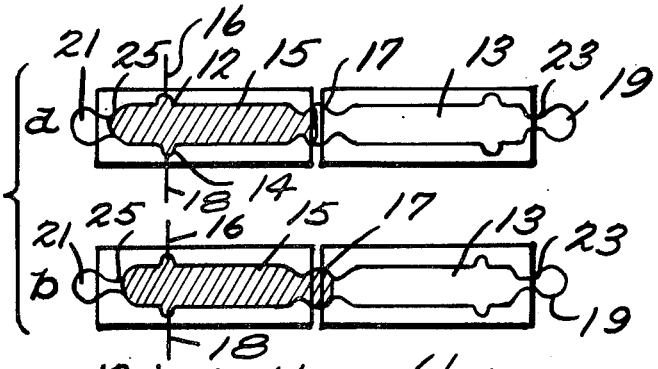
FIG. 5 is a schematic planar view illustrating the effect of applying a voltage across one chamber of the switch.

Refer now to FIG. 5 where there is disclosed a schematic illustration of the electrostatic switch of the present invention wherein the upper and lower conductors bordering the chambers 13 and 15 are formed with serrations therein, as illustrated in FIGS. 3 and 4. In FIG. 5*a* there is shown the condition of the conductive liquid positioned within chamber 15 when a voltage is applied across the conductive plates which border the top and bottom of the chamber 15. As illustrated, the conductive liquid is positioned within the cavities 12 and 14 and chamber 15 and is drawn inwardly from the constricted area 17 so that in general the liquid does not extend under the conductive plates which border the chamber 13. Referring to FIG. 5*b*, when the voltage across the conductive plates which border the chamber 15 is inhibited, the conductive liquid relaxes, as illustrated in FIG. 3, so that the liquid substantially fills the constricted area 17. In this arrangement, the liquid thus extends under the conductive plates which define the top and bottom of the chamber 13 so that when a voltage is applied to these conductive plates, the conductive liquid is drawn from chamber 15 into chamber 13 to thereby open the electrical circuit between conductive elements 16 and 18.

Figure 6:
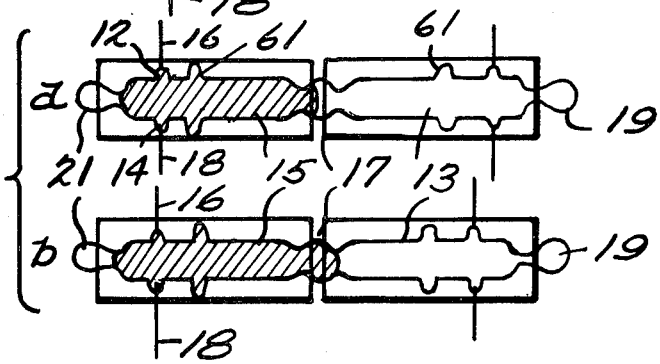
FIG. 6 is a schematic illustration of the effect of applying a voltage across one of the chambers of the switch wherein the conductive plates defining the top and bottom of the chamber are flat.

Refer now to FIG. 6 where there is an illustration of an embodiment wherein no serrations are provided in the substrates which define the top and bottom of the chambers 13 and 15. In this embodiment in order to insure that the liquid conductor partially extends under the plates defining the upper and lower bounds of the chamber 13 when no voltage is applied to these plates, at least one second cavity 61 is provided in each of the chambers 13 and 15. Thus, as illustrated in FIG. 6*a*, when a voltage is applied across the conductive plates positioned over the chamber 15, the conductive liquid is drawn into the chamber 15 and into the cavities 61 as well as the cavities 12 and 14. In addition, the conductive liquid is extended only partially into the constricted area 17 such that it does not pass under the conductive plates which border the upper and lower portion of the chamber 13. When the voltage across the conductive plates defining the top and bottom of the chamber 15 is removed, as shown in FIG. 6*b*, the conductive fluid within chamber 15 relaxes such that the liquid fills the constricted area 17 thereby extending under the conductive plates which define the upper and lower bounds of the chamber 13. The movement of the conductive liquid into the constricted area 17 is achieved by having the liquid flow out of the cavities 61, as illustrated in the figures. A funnel shape on the end of chambers 15 or 13 near holes 21 or 19 could replace the effect of cavities 61.

The liquid actions depicted in FIGS. 5 and 6 may seem unnecessary until one considers methods for filling substantially one chamber with liquid after the switch is closed. It would be possible to do the filling independent of serrations or cavities 61 if all chambers have the same dimensions and fluid metering is used. However, in the present invention exact mechanical tolerances can be waived and switches can be stacked in more than one layer before filling.

Refer now to FIG. 7 which is a schematic illustration of the switching arrangement of the present invention shown in a switching array. An intermediate layer 111 is illustrated having an array of chambers 113 and 115 formed therein in rows and columns. Each of the chambers 113 and 115 is formed in a manner similar to that illustrated in FIG. 1, with the chambers being connected by a constricted region 117 therebetween. At the ends of each of the chambers is a channel 123 and 125 which connects to an access hole 119 and 121, respectively, which holes in turn connect to the outside of the switch for permitting conductive liquid to be introduced into the chambers 115 and 113. A plurality of horizontally oriented conductive lines 120 and 120' and 120'' are formed on the upper surface of the layer 111 by suitable means known in the art such as by integrated circuit techniques. A lead line 116 extends from each of the conductors 120–120'' to the associated cavity 114 of the chamber 115 for the purpose of conducting current with respect to the chamber 115 when a conductive liquid is positioned therein. On the underside of the layer 111 is formed a second series of conductive buses 122, 122', 122'' which are formed on the layer 111 by suitable techniques known in the art. A second series of conductors 118 extend from the conductive buses 122–122'' to the cavities 112 associated with the chamber 115. Thus, an array is provided wherein current can be conducted through a selected chamber or a group of selected chambers 115 depending on which chamber or chambers have a conductive fluid or liquid positioned therein.

Positioned to the underside of layer 111 is a dielectric substrate 127 having conductive plates 129 and 131 deposited thereon in the form of an array of rows and columns wherein the conductive plates 129 and 131 are positioned under the chambers 113 and 115, respectively, in the manner illustrated in FIGS. 1 and 1*a*. In addition, holes 144 and 143 are formed to each side of the conductive plates 129 and 131 which holes communicate with the openings 119 and 121, respectively, in the intermediate layer 111. As discussed in connection with the description of the embodiment of FIG. 1, these holes are for the purpose of permitting a liquid conductor to be passed into and out of the chambers 113 and 115. A first conductor 133 electrically connects each of the conductive plates 129 while a second conductor 135 serially connects each of the conductor plates 131 in a given column. Because the conductor plates are formed in an array of rows and columns, a plurality of such conductors 133, 133', 133'', etc. and 135, 135', 135'', etc. are required as illustrated in the drawings.

Positioned on top of the intermediate layer 111 is a second dielectric substrate 137 having conductive plates 139 and 141. The conductive plates are positioned over the top of the chambers 113 and 115, respectively, so that the chambers 115 and 113 are enclosed at the top and bottom by means of the conductive plates and the dielectric substrates 127 and 137. Dielectric substrate 137 in addition has a plurality of holes 144 and 143 positioned at the sides of the conductive plates, which holes mate with the holes 143 and 144 of the dielectric substrate 127 and the holes 119 and 121 of the intermediate layer 111 for the purpose of permitting the conductive liquid to ingress and egress with respect to the chambers 113 and 115, when desired. Under ordinary circumstances, these holes are shut preferably by means of a removable material so that the switch can be periodically serviced. A first set of horizontally oriented conductive lines 150 electrically connects each of the plates 139 in a particular row. In addition, a second conductive line 152 interconnects each of the conductive plates 141 in a particular row. Because the conductive plates in the substrate 137 are formed in an array, a plurality of such lines 150, 150', 150'', etc. and 152, 152', 152'', etc. are required as illustrated.

When the switch is formed by placing the substrate 137 on top of dielectric 111 and substrate 127 under dielectric 111 and appropriately filling with conductive liquid, the switch is ready for operation.

In operation, assume for example tht current is to be conducted between conductor 120' and 122' and to no other lines from these lines. This requires that conductive liquid be introduced to the chamber 115 in the middle switch of the array and that conductive liquid be moved the chamber 113 of all other switches in the middle row and middle column thus insuring connection while preventing multiple connection. The desired effect can be produced as follows. First a voltage is applied to each of the lines 150, 150' and 150'' in substrate 137 and a different voltage is applied to the conductive line 133' in substrate 127 so as to force the conductive liquid in each of the switching elements of the middle column into the chamber 113 thereby opening all circuits in this column. Second, a voltage is applied to each of the lines 133, 133', and 133'' in substrate 127 and another voltage is applied to the conducting line 150' in substrate 137 so as to force the conductive liquid in each of the switching elements of the middle row into the chamber 113 thereby opening all circuits in this row. Third, a voltage is applied to the row oriented conductor 152' on substrate 137 and to the conductor 135' on substrate 127. In this situation the liquid conductor is forced into chamber 115 of the middle switching element to thereby connect the lines 120' and 122', thus completing the desired effect.

From the foregoing it can be seen that an addressable memory system or switching system can be provided by the electrostatic switching arrangement of the present invention. Other switching arrangements, for instance destructive mark operation, will be obvious to those skilled in the art.

Figure 8:
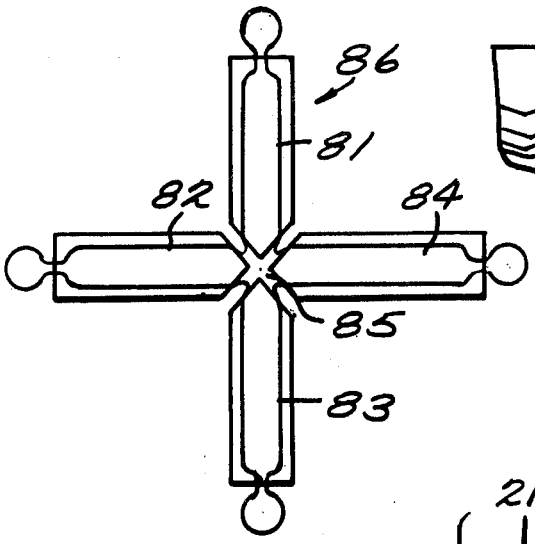
FIG. 8 is a plan view of an alternative embodiment of the present invention illustrating schematically a four-way electrostatic switch.

Refer now to FIG. 8 which is a schematic illustration of an alternate embodiment of the invention showing four chambers 81, 82, 83 and 84 joined by a single constricted area 85 to form a four-way switch. Thus on a single intermediate substrate 86 or on a plurality of substrates joined to form a single substrate layer, four chambers are formed, only one of which has a suitable conductive liquid positioned therein. Positioned on each side of layer 86 is a dielectric substrate having conductive plates formed thereon by means known in the art. As in the aforementioned embodiments, a thin dielectric layer is formed over the conductive plates to electrically isolate the plates from the liquid conductor. As illustrated, the conductive plates have a "V" shaped end portion which extends into the constricted area 85 so that when a voltage is applied to a pair of plates, and hence across a selected one of the chambers 81–84, the liquid conductor is drawn into the appropriately addressed chamber. The details of the switch, including the electrical connections and the cavities, are not illustrated in this figure since the concept is the same as in the switch of FIGS. 1 and 2 and in order to more clearly and concisely describe the novel aspect of the embodiment of FIG. 8, namely, a fourway electrostatically operated switch.

Figure 12:
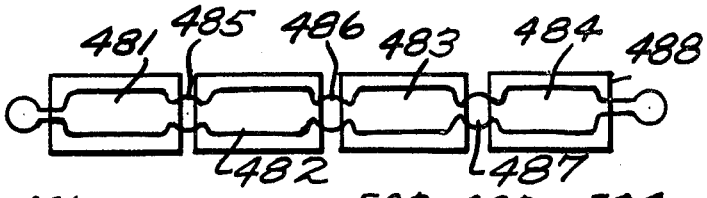
FIG. 12 is a plan view of an alternative embodiment of the present invention illustrating schematically a switch consisting of a string of four chambers.

Refer now to FIG. 12 which is a schematic illustration of an alternate embodiment of the invention showing four chambers 481, 482, 483, and 484 in a string joined by constricted regions 485, 486, and 487 to form a multimode switch. If only one chamber is filled then a circuit or circuits for any one chamber can be activated while circuits through the remaining chambers are deactivated. On a single intermediate substrate 488 or on a plurality of substrates joined to form a single substrate layer, four chambers are formed in a string, only one of said chambers having a suitable liquid positioned therein. Positioned on each side of layer 488 is a dielectric substrate having conductive plates formed therein by means known in the art, as shown by the rectangles of FIG. 12. As in the aforementioned embodiments, a thin dielectric layer is formed over the conductive plates to electrically isolate the plates from the liquid conductor. The plates of each chamber extend far enough so that when the conductive liquid is in an adjoining chamber and no voltage is applied the plates of said chamber will sandwich part of the liquid extending out from the adjoining chamber. Thus when a voltage is applied across a pair of plates and hence across a selected one of the chambers 481 through 484, the liquid will be drawn into the appropriately electrified chamber if said liquid resides in an immediately adjoining chamber. Notice that in the no voltage state when liquid resides in one chamber it also resides in all contiguous constricted regions. Therefore the volume of each chamber must be appropriately chosen within certain tolerances. As with FIG. 8, the details of the switch, including the electrical connections and the cavities, are not illustrated in this figure since the concept is the same as in the switch of FIGS. 1 and 2, and in order to more clearly and concisely describe the novel aspects of the embodiment of FIG. 12, namely a multichamber string configured electrostatically operated switch.

Figure 13:
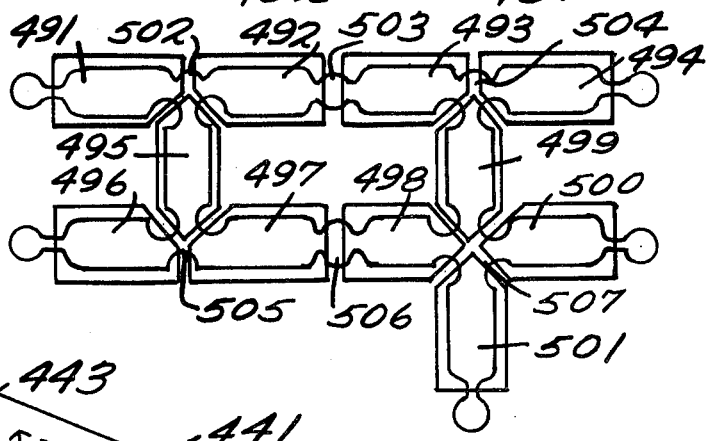
FIG. 13 is a plan view of an alternative embodiment of the present invention illustrating schematically a switch combining aspects of those in FIGS. 12 and 8.

Refer now to FIG. 13 which is a schematic illustration of an alternative embodiment of the invention showing eleven chambers 491–501 with constricted regions 502–507 each joining selected groups of chambers. The extension from FIGS. 8 and 12 is apparent and the construction of the switch is analogous. Notice chambers 491 through 494 and constricted regions 502 through 504 from a string type subswitch similar to that of FIG. 12. Notice that chambers 498 through 501 and constricted region 507 form a subswitch similar to that of FIG. 8. Notice also a new subswitch made up of chambers 493, 492, 495, 497, 498 and 499 together with all the constricted regions. This subswitch is in the form of a ring and could be used for instance as an alternative electronic ignition system. Notice further that groups as in FIG. 8 can be joined by groups as in FIG. 12 and vice versa. As with the descriptions of FIGS. 8 and 12 the details of the switch, including the electrical connections and the cavities, are not illustrated in FIG. 13 since the concept is the same as in the switch of FIGS. 1 and 2 and in order to more clearly and concisely describe the novel aspect of the embodiment of FIG. 13, namely combinations of FIG. 8, FIG. 12, and rings. Other applications mights include a sequenced door lock wherein the liquid must travel a maze to unlock the door.

Figure 14:
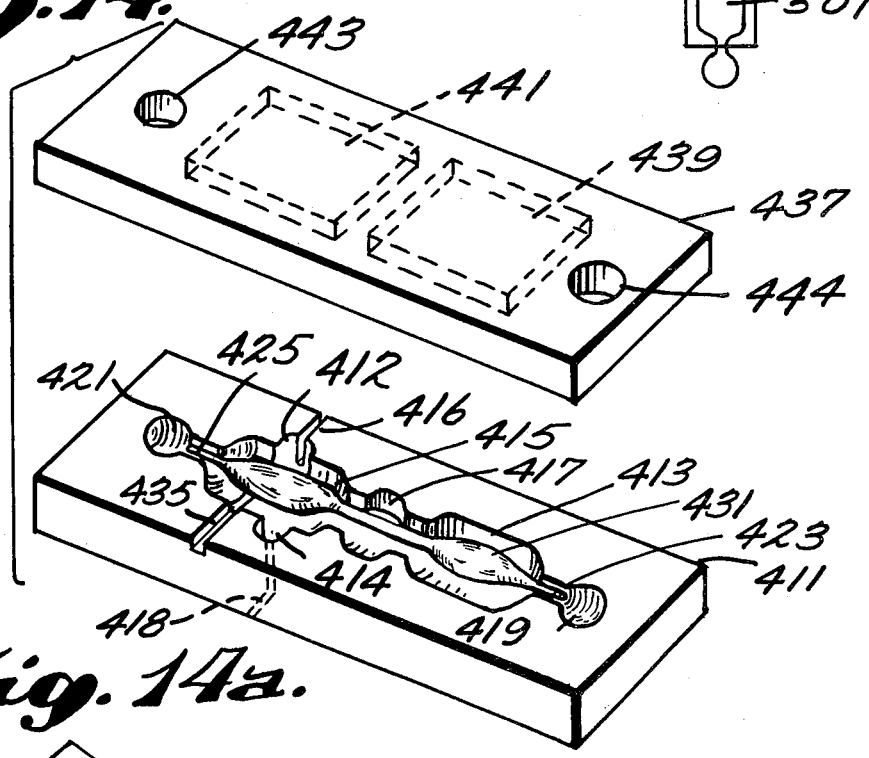
FIG. 14 is an exploded perspective view of an alternative embodiment of the electrostatic switch of the present invention.
Figure 14A:
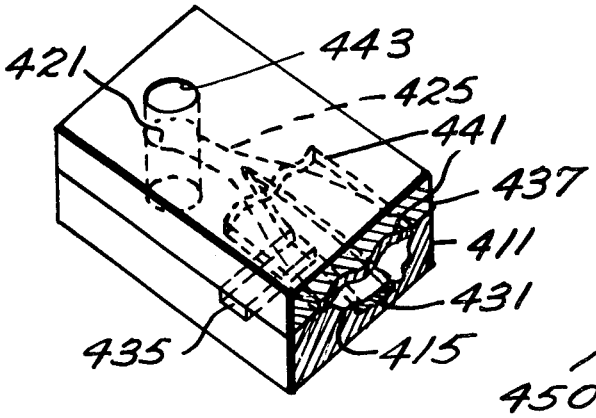
FIG. 14*a* is a partial perspective view of the switch of FIG. 14.

Refer now to FIGS. 14 and 14*a* which is an embodiment of a similar invention. It is mentioned mainly in order to claim the features associated with filling the switch with the proper amount of liquid after final assembly of the solid parts of the switch and the features associated with serrations and cavities to facilitate switching. A first dielectric plate 411 which is of a relatively thin elongated structure has a first and second chamber 413 and 415, respectively formed therein, which chambers are connected by a constricted region 147. The chambers and constriction extend into the face of plate 411 but not through the plate. At the far end of each of the chambers is a through-hole 419 and 421, which through-holes are connected to the chambers 413 and 415, respectively, by means of channels 423 and 425, respectively.

If an electric relay is desired, cavities 412 and 414 are formed on opposite sides of at least one of the chambers, as illustrated, in order to entrap a conductive liquid therein. Two cavities are shown to make the figures analogous to FIGS. 1 and 1*a*. However, if conductor 431 is left uncovered said conductor could be used as the second terminal. A conductor 416 is plated by known techniques onto the plate 411 such that the conductive material extends from the outside edge of the plate 411 to the cavity 412 and then extends downwardly along the wall of the cavity in a vertical direction to ensure a good electrical contact with the conductive liquid which is entrapped in the cavity. On the opposite side of the chamber of conductive strip 418 is plated by known techniques on the underside of the plate 411 such that the conductor extends from a position remote from the chamber 415 to the cavity 414 and then upwardly along the wall of the cavity, as illustrated by the dotted lines. While the conductor is shown as plated onto the plate 411, it should be understood that the conductor could be in the form of a wire which projects into the cavities 412 and 414. A conductor 435 is plated by known techniques onto plate 411 such that the conductive material extends from the outside edge of plate 411 to contact a similar conductor 431 which extends along inside chambers 415 and 413 and through constriction 417. In operation this conductor 431 will always contact the working liquid of the switch. The conductor 431 somewhat replaces the function of plates 31 and 29 of FIG. 1. It should be understood that the path by which conductor 435 connects conductor 431 with the outside may be altered.

Positioned above plate 411 is a substrate plate 437 which plate is formed of a dielectric material. Electrode plates 441 and 439 are formed on the lower surface of the dielectric substrate 437 by one of several known means, such as for example, sputtering, spraying, painting, etc. These electrodes are connected to electric lines (not shown) which may be formed on the substrate 437 by means of spraying, sputtering etc. A very thin dielectric coating (not shown) is placed or deposited or formed over the conductive plates and a possibly thicker coating is placed over the electric lines. The dielectric coating on the plate may be an oxide layer formed by anodizing the metal of the conductive plates and in one alternative the coating on the electric lines may be simply another laminar layer. The substrate 437 is secured to the top side of dielectric plate 411 by any suitable technique known in the art to form a composite switch such as is illustrated in partial section in FIG. 14*a*. As illustrated in FIG. 14*a*, the chamber 415 formed in the dielectric plate 411 is bordered on the top by the conductive plate 441. Conductor 431 forms part of the chamber wall.

Figure 14B:
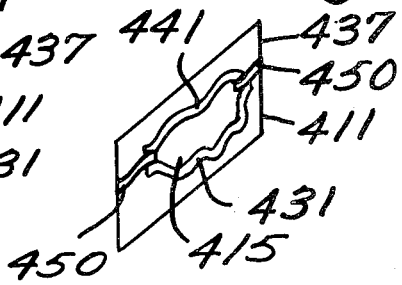
FIG. 14*b* is a partial view of a similar switch modified to be more suitable if all plates are to be insulated.

If in a different version we wish to electrically isolate conductor 431 from the working liquid the conductor 431 should be widened and positioned such that it recedes under a third substrate layer 450 as shown in FIG. 14*b* which figure corresponds to the front end of 14*a*. Notice that a liquid in chamber 415 will never be near an edge of conductor 431 in this version. Conductor 431 should also be covered with a dielectric coating.

In the version wherein the conductor 431 is not covered by a dielectric material any conducting liquid in the switch will function as a capacitor plate connected to line 431. Filling occurs through hole 443 with a voltage applied across plate 441 and conductor 431 or through hole 444 with the voltage being applied to plate 439 with respect to conductor 431. After filling, when the voltage is relaxed, the working fluid will be touching the coatings of both plate 441 and plate 439, at least at some point.

Refer now to FIG. 9 which illustrates an alternative embodiment of the invention wherein fluid or light can be switched on or off depending upon the position of the conductive liquid within the chambers of the switch. As illustrated in FIG. 9, an intermediate dielectric substrate 211 is provided with a pair of chambers 213 and 215 therein. Each of the chambers has at least one cavity 261 therein and the chambers are joined together by a constricted region 217. At the opposite end of the chambers 213 from the constricted area 217 is a hole 219 which communicates with the chamber 213 via a channel 223. At the opposite end of chamber 215 from the constricted region 217 is a second hole 221 which communicates with the chamber 215 via a second channel 255.

Positioned to the top of dielectric 211 is a dielectric substrate 237 having a pair of conductive plates 239 and 241 formed on the lower surface thereof. These plates are insulated from conductive liquid which is in either chamber 213 or 215 by means of an oxide dielectric layer positioned over the top of the conductors 239 and 241. A pair of holes 243 and 244 are provided which are in alignment with the holes 221 and 219, respectively, of the layer 211. Formed in the substrate 237 is a channel 265 which terminates in a relatively small inlet bore 267 which permits direct communication of a fluid or light energy with the chamber 213. As illustrated, the bore 267 is substantially smaller than the channel 223 or the constricted area 217 so that the conductive liquid does not pass up through the bore 267 and out of the switch via channel 265.

To the bottom of dielectric layer 211 is a second dielectric substrate 227 having a pair of conductive plates 229 and 231 positioned thereon by techniques known in the art. A dielectric layer is positioned over the top of these plates so as to electrically insulate these plates from the conductive liquid which is in chamber 213 or 215. As illustrated, a channel 269 is formed in the substrate 227 which channel is terminated in a small bore 271 which leads directly into the chamber 213.

Thus, fluid or light energy can be conducted from an external source through the channel 269 and through bore 271 to the chamber 213. The bore 271 is directly aligned opposite the bore 267 so as to permit fluid energy or light energy to be coupled from the channel 265 and bore 267 in the substrate 237 to the channel 269 and bore 271 in the substrate 227.

In order to facilitate the movement of the conductive liquid between the chambers 213 and 215, a small bore 273 is formed in the substrate 227 through conductive plate 229. In addition, a second small bore 275 is formed in the substrate 227 which extends through the conductive plate 231. A fourth layer 281, which may be a dielectric or otherwise, is provided which is fixedly secured to the underside of the dielectric substrate 227. This layer has a trough or channel 282 formed therein which trough communicates the bore 273 with the bore 275. While the trough is shown in a curved position to obviate passing through the channel 269, it should be understood that if the bores 273 and 275 were positioned to one side of the conductive plates 229 and 231, the trough 282 could be in the form of a straight line extending across the layer 281. Layer 281 also forms the fourth side of channel 265 when switches are stacked.

In operation when, for example, the conductive liquid is forced into the chamber 213 by applying a voltage across the plates 239 and 229, the air or gas in the chamber 213 moves downwardly through bore 273 through the trough 282, up through bore 275 and into chamber 215 to thereby facilitate movement of the conductive liquid into the chamber 213. When chamber 213 is filled with the liquid conductor, fluid conducted through the channel 265 and bore 267 is cut off from passing through bore 271 and channel 269. In the same sense, if light is being conducted through the channel 265, which would in this case be in the form of a fiber optic, the light beam would be cut off by the conductive liquid.

When the conductive liquid is forced into chamber 215 by applying a voltage across the conductive plates 231 and 241, gas or air in the chamber 215 is forced downwardly through bore 275, trough 282 and upwardly into chamber 213 via the bore 273, thus facilitating the movement of the conductive liquid into the chamber 215. After the conductive liquid has left chamber 213, fluid or light energy can then readily pass between the substrates 237 and 227. It should be understood that while light energy or a fluid is shown coupled to only one chamber, i.e., chamber 213, such light or fluid energy could be conducted, in addition, to chamber 215 thereby forming a two-way switching arrangement.

Refer now to FIG. 10 which is a partial section view of the switch of FIG. 9 shown in perspective. The dielectric substrate 237 is shown fixedly secured to the dielectric layer 211 by means known in the art. As illustrated, the dielectric substrate 237 has a conductor 241 plated thereon by means known in the art and a very thin dielectric layer (not shown) is formed over the plate 241 so as to insulate the plate 241 from the conductive liquid which is positioned in the chamber 215 formed in the layer 211. Positioned under the layer 211 is a second dielectric substrate 227 having a conductor 231 deposited thereon by techniques known in the art. A dielectric layer, which is very thin and accordingly is not illustrated in the drawings, is deposited on the conductive plate 231 to thereby electrically insulate the conductive plate 231 from the conductive liquid positioned within the chamber 215. A bottom layer 281 is provided having a trough 282 formed therein which communicates with the chamber 215 via a small bore 275. The bore 275 has to be small in comparison with the constricted area between the chambers 213 and 215 so as to prevent the conductive liquid from passing into the bore 275 and through the trough 282. Each of the respective layers is secured to one another by suitable means known in the art.

A tube 291 which may be, for example, a fiber optic or a fluid conducting tube, is fixedly secured to a hole extending through the substrate 237 and the conductive plate 241. A second tube 292 of similar design to tube 291 and vertically aligned therewith is positioned in a hole which extends through the layer 281, substrate 227 and conductive plate 231. Hence, fluid or light can be directed through the tubes 291 and 292 when no conductive liquid is positioned in the chamber 215. However, when a conductive liquid is placed in the chamber 215, the conduction of fluid or light through the tubes 291 and 292 is blocked.

Refer now to FIG. 11 which is a schematic illustration of yet another embodiment of the invention. As illustrated, a transparent center dielectric plate 311 is formed having chambers 313 and 315 therein, which chambers are connected by a constricted region 317. A light ray 318 is directed through the transparent layer 311 in an almost straight line depending on the refractive index of the conductive liquid in chamber 315 with respect to that of the transparent layer. The solid line illustrates a nearly equal index of refraction. On reaching the opposite side of the transparent layer 311, the light is either received or further guided. However, when the conductive liquid is forced out from chamber 315 in the manner described in connection with the embodiment of FIGS. 1, 1*a* and 2, the light is either refracted as shown by the dotted lines or is internally reflected in transparent layer 311, thus in either case taking a different path from the nearly straight line. Thus by changing the path of the light as it leaves the electrostatic switch of the present invention, a switching function is achieved.

By certain obvious modifications a switch such as the ones shown in FIGS. 14, 14*a* and 14*b* can be modified to resemble and function similarly to the fluidic and optical switches described above.

As with the electrical switch arrays, arrays of fluidic or optical switches can be used for special purposes. If for example electrostatically controlled optical switches contain colored liquid, they can be used to make rapid color comparisons if light is forced to pass through a series of switches. If each succeeding switch has twice the color absorptivity of the previous one, then a binary number representing the color magnitude will be achieved when matching occurs. If switches 2, 5 and 6 are on at comparison then the binary magnitude is 110010 or 50 in the decimal system. The matching could easily be automated electronically by checking the comparison after switching on each color switch in order from greatest to least.

In the above descriptions of optical and fluidic switches it should be understood that in most designs a dielectric liquid could be substituted for the conductive liquid and if the substitution is made the conductive control plates need not be coated with insulating material to electrically isolate the conductive plates from the working liquid. The only exceptions are designs wherein the conductive liquid acts directly as one capcitor plate, that is, wherein an electrical control line is in electrical contact with the working liquid.

By this invention applicant has provided an improved electrostatic switch capable of use in memory systems, telephone switching systems, fluid switching arrangements and in optical systems. The switch is of simplified construction and can be easily made by known mass production techniques and in addition, provision is made for easily servicing the switch by removing the conductive liquid from the switch, blowing the chambers out, resurfacing the plates and then re-introducing the conductive liquid into the switch for operation. Hence, a reliable switch capable of being formed by integrated circuit techniques has been disclosed and described herein.

While the present invention has been disclosed in connection with the preferred embodiments thereof, it should be understood that there may be other obvious variances of the present invention which fall within the spirit and scope thereof as defined by the appended claims.

What is claimed is:

1. An electrostatically controlled fluidic switch comprising a dielectric structure having a plurality of chambers formed therein and each of said chambers being joined to at least one other chamber of the group by a constricted region between said pair of chambers, the volume of any said constricted region or regions being substantially smaller than any of said chambers, a pair of conductive plates positioned on opposite sides of each of said chambers, each such pair of plates substantially sandwiching one and only one chamber, and each pair of plates extending to partially sandwich any said constricted region adjoining the chamber upon whose opposite sides the plates are, a liquid positioned in one of said chambers and extending somewhat beyond the chamber into but not beyond any adjoining said constricted region when no voltage is applied to the system so that said liquid is also between a portion of the plates associated with any chamber adjoining mutually to the liquid containing chamber through a said constricted region, at least some respective area on the surface of any given said constricted region, each said constricted region having its own separate said area, which respective area is an area of overlap, being contacted at all points by said liquid extending from its chamber whenever the said liquid is resting in any said chamber adjoining the given said constricted region with no voltage applied to the system, the same said area of overlap being contacted at all points by said liquid no matter which adjoining said chamber contains the main body of the liquid at rest, means for establishing a voltage across the conductive plates of any one of said chambers, and means positioned at a plurality of points in said at least one chamber for conducting fluid with respect to said at least one chamber to and from the chamber, the fluid path through said chamber with respect to said means being impeded when and only when the liquid is in said at least one chamber, said liquid being moved into said at least one chamber when a voltage is established across the conductive plates positioned on opposite sides of said at least one chamber providing that the liquid to be moved is resting in an adjoining chamber at the time of establishment of a sufficient voltage, that no voltage is being simultaneously applied across any chamber other than said selected chamber which could interefere with liquid movement, and that said sufficient voltage is held for a sufficient time.

2. The electrostatic switch of claim 1 wherein the liquid is conductive and electric insulation covers the conductive plates.

3. The electrostatic switch of claim 1 further comprising at least one cavity formed on each chamber for receiving said liquid when a voltage is applied across the chamber on which said cavity is formed, and wherein said liquid flows out of said cavity when said voltage across said chamber is relaxed, thus moving some liquid from between the plates into any constricted region adjoining the said chamber.

4. The electrostatically controlled fluidic switch of claim 1, further comprising means for introducing said liquid into said chambers after the switch is complete other than adding liquid wherein said means for introducing liquid to one of said chambers includes at least one hole extending from the exterior of said switch to one of said chambers and wherein said holes are sealed with a removable sealant after said liquid is introduced into said chamber.

5. The electrostatically controlled fluidic switch of claim 1 further comprising means for communicating gas between said chambers and around said liquid to thereby facilitate movement of said liquid from one chamber to another.

6. The electrostatic switch of claim 1, wherein the conductive plates together with at least part of the insulation covering said plates comprise an anodized metal.

7. An electrostatic switch comprising a dielectric structure having a plurality of chambers formed therein, each of said chambers being joined to at least one other chamber of the group by a constricted region between said pair of chambers, the volume of any said constricted region or regions being substantially smaller than any of said chambers, a conductive plate positioned on one or more sides of each of said chambers said plate being covered with electrical insulation, each such plate being on one and only one chamber, and each such plate further extending to be also positioned on part of a side wall of any said constricted region adjoining the chamber upon whose wall the plate mainly resides, a bare electrical conductor running through the chambers so that said bare conductor is positioned substantially opposite each of said conductive plates, a conductive liquid positioned within one of said chambers and extending somewhat beyond the chamber into but not beyond any adjoining said constricted region when no voltage is applied to the system so that said liquid also touches a portion of the insulated conductive plate associated with any neighboring chamber communicating with the liquid containing chamber through a said constricted region, at least some respective area on the surface of any given said constricted region, each said constricted region having its own separate said area, which respective area is an area of overlap, being contacted at all points by said liquid extending from its chamber whenever the said liquid is resting in any said chamber adjoining the given said constricted region with no voltage applied to the system, the same said area of overlap being contacted at all points by said liquid no matter which adjoining said chamber contains the main body of the liquid at rest, means for establishing a voltage between the bare electrical conductor and the insulated conductive plate of any one of said chambers, and means positioned at a plurality of points in at least one said chamber for conducting fluid with respect to said at least one chamber, to and from the chamber, the fluid path through said chamber with respect to said means being impeded when and only when the said conductive liquid is in said at least one chamber, said conductive liquid being moved into a selected said chamber when a sufficient voltage is established between the bare electrical conductor and the insulated conductive plate of said chamber if the liquid to be moved is resting in an adjoining said chamber at the time of voltage establishment, if no voltage is being established between the bare conductor and the insulated conductive plate of any chamber other than said selected chamber which could interfere with liquid movement, and if said sufficient voltage is held for a sufficient time.

8. The electrostatic switch of claim 7 further comprising means for introducing conductive liquid into one chamber of the switch after the chambers are permanently closed, wherein said means for introducing conductive liquid to one of said chambers includes at least one hole extending from the exterior of said switch to said one of said chambers wherein said holes are sealed with a removable sealant after said conductive liquid is introduced into said chamber.

9. The electrostatic switch of claim 7 further comprising at least one cavity formed on each chamber for receiving said conductive liquid when a voltage is applied across the chamber on which said cavity is formed, and wherein said conductive liquid flows out of said cavity when said voltage across said chamber is relaxed, the liquid thus extending beyond the chamber into any constricted region adjoining the said chamber.

10. An electrostatic switch comprising a metallic sheet which is coupled with a dielectric structure such that when the metal and dielectric are joined together a plurality of chambers are formed between their surfaces each of said chambers being joined to at least one other chamber of the group by a constricted region between said pair of chambers, the volume of any said constricted region or regions being substantially smaller than any of said chambers, a conductive plate being positioned on one or more sides of the dielectric inside surface of each of said chambers, each such plate being on the surface of one and only one chamber, and each such plate further extending to be also positioned on part of a side wall of any said constricted region adjoining the chamber upon whose surface the plate mainly resides, a liquid positioned within one of said chambers and extending somewhat beyond the chamber into but not beyond each adjoining said constricted region when no voltage is applied to the system so that said liquid also touches a portion of the conductive plate associated with any neighboring chamber communicating through a said constricted region, at least some respective area on the surface of any given said constricted region, each said constricted region having its own separate said area, which respective area is an area of overlap, being contacted at all points by said liquid extending from its chamber whenever the said liquid is resting in any said chamber adjoining the given said constricted region with no voltage applied to the system, the same said area of overlap being contacted at all points by said liquid no matter which adjoining said chamber contains the main body of the liquid at rest, means for establishing a voltage between the metallic sheet and the conductive plate of any one of said chambers, said liquid being moved into a selected said chamber when a sufficient voltage is established between said metallic sheet and the conductive plate of said chamber if the liquid to be moved is resting in an adjoining said chamber at the time of voltage establishment, if no voltage is being established between the said metallic sheet and the conductive plate of any other said chamber than said selected chamber which could interfere with liquid movement to said selected chamber, and if said sufficient voltage is held for a sufficient time, and further comprising means positioned at a plurality of points in at least one said chamber for conducting fluid with respect to said at least one chamber to and from the chamber, the fluid path through said chamber communicating between said means being impeded when and only when the liquid is in said at least one chamber.

11. The electrostatic switch of claim 10 further comprising one or more holes leading to the chamber group which serve as an entrance for filling a chamber with liquid after the chambers are permanently formed and wherein said holes are sealed with a removable sealant after said liquid is introduced.

12. The electrostatic switch of claim 10 further comprising at least one cavity formed on each chamber for receiving said liquid when a voltage is applied across the chamber on which said cavity is formed, and wherein said liquid flows out of said cavity when said voltage across said chamber is relaxed, the liquid thus extending beyond the chamber into each constricted region adjoining said chamber.

* * * * *